United States Patent [19]

Odermann

[11] 4,091,752

[45] May 30, 1978

[54] BUTTONHOLE GAUGING PRESSER DEVICE

[75] Inventor: Charles Robert Odermann, Montville, N.J.

[73] Assignee: The Singer Company, New York, N.Y.

[21] Appl. No.: 787,182

[22] Filed: Apr. 13, 1977

[51] Int. Cl.[2] ..... D05B 3/06; D05B 3/24

[52] U.S. Cl. ..... 112/75; 112/77

[58] Field of Search ..... 112/75, 77, 70, 65, 112/158 B, 136; 33/190, 189

[56] References Cited

U.S. PATENT DOCUMENTS

| | | | |
|---|---|---|---|
| 3,137,254 | 6/1964 | Enos et al. | 112/75 |
| 3,752,093 | 8/1973 | Loeffler | 112/75 |
| 3,877,403 | 4/1975 | Ketteren | 112/77 |

*Primary Examiner*—H. Hampton Hunter

*Attorney, Agent, or Firm*—Robert E. Smith; Edward L. Bell; Julian Falk

[57] ABSTRACT

A buttonhole gauging presser device usable on sewing machines with or without automatic buttonhole mechanisms. This presser device includes button engaging projections which position both a cam for actuating an automatic buttonholing mechanism as well as visual indicating means. At the start of buttonhole sewing the visual indicating means occupies a position in advance of the sewing needle or indicia on the presser foot, and then as the buttonhole is stitched, the visual indicating means moves into alignment with the needle (or indicia) which serves a signal to the operator of a manual sewing machine that an operator-initiated action is required to have the sewing machine create a buttonhole end and reverse direction.

6 Claims, 8 Drawing Figures

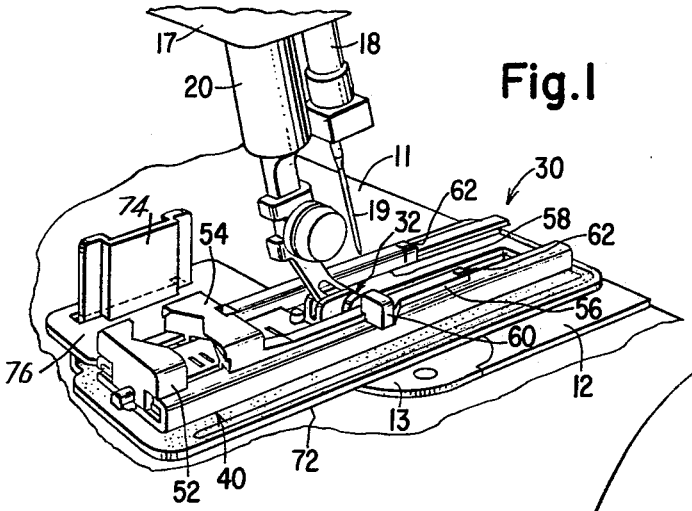
Fig.1
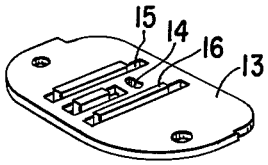
Fig.3
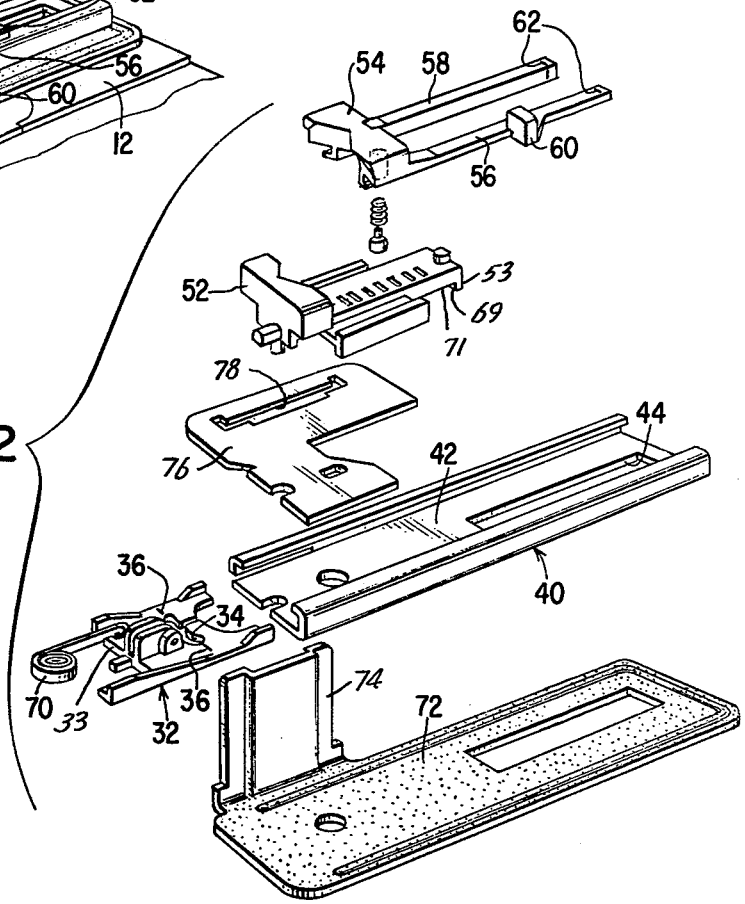
Fig.2
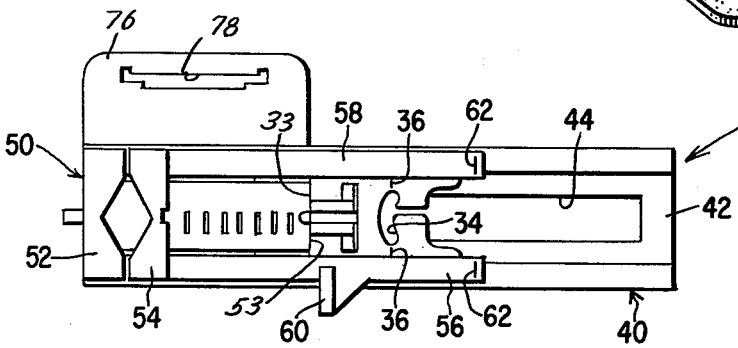
Fig.4
Fig.5A
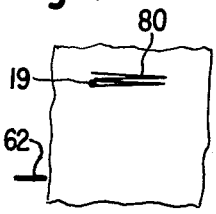
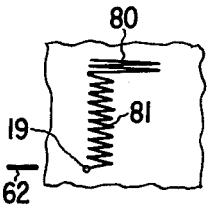
Fig.5B
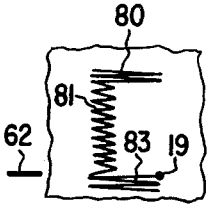
Fig.5C
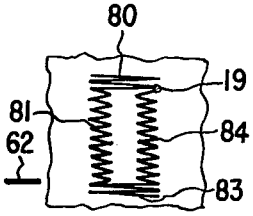
Fig.5D

BUTTONHOLE GAUGING PRESSER DEVICE

BACKGROUND OF THE INVENTION

This invention relates to buttonholing attachments for sewing machines, and in particular, to those devices which establish the size of the buttonhole to be sewn.

Buttonhole gauges, in themselves, are not new. One such device attachable to the presser bar of a sewing machine is disclosed in U.S. Pat. No. 3,137,254 of Enos et al. This device, which extends rearwardly from the presser bar, holds a button and positions a guide which, after sewing is commenced, will align with the trailing end of the stitching indicating that the proper length of buttonhole, for the button selected, has been achieved. This type of indication, however, being rearward of the stitching point, may create problems for the operator. When performing a sewing operation, the operator's attention is normally directed primarily at or in advance of the point where the sewing needle is penetrating the material and, moreover, the stitching rearwardly of the stitching point is hidden by the presser device. This being so, the stitching is apt to progress past the indicator of the Enos device without the operator noticing the same. In addition, by being stationary with respect to the sewing machine, the Enos device does not lend itself to being used with a sewing machine having an automatic buttonholing device as, for example, described in U.S. Pat. No. 3,841,246 by Castner et al.

SUMMARY OF THE INVENTION

The object of this invention is to provide a buttonhole gauging presser device in which visual means for indicating the size of a buttonhole is readily visible. The object is achieved by extending an indicator, which moves with the fabric, to some predetermined point in advance of the actual stitching and by placing indicia on the presser foot such that when the indicator and the indicia are aligned, a proper length buttonhole has been sewn.

A further object of this invention is to provide a buttonhole gauging presser device which is usable both on sewing machines having an automatic buttonholing mechanism as well as manual zig-zag sewing machines.

With the above and additional objects and advantages in view as will hereinafter appear, this invention will be described in reference to the accompanying drawing of the preferred embodiment.

DESCRIPTION OF THE DRAWING

FIG. 1 is a perspective view of a buttonhole gauging presser device of the invention as attached to a sewing machine.

FIG. 2 is an exploded perspective view of the invention.

FIG. 3 is a perspective view of the sewing machine throat plate with the feed dog exposed.

FIG. 4 is a top plan view of the invention showing the relative position of the indicator and the indicia on the presser foot.

FIGS. 5 A,B,C & D show the sequence of different steps in the fabrication of a buttonhole along with the relative position of the indicator of the invention.

DESCRIPTION OF THE PREFERRED EMBODIMENT

In the drawing, 11 refers to the work supporting bed of a sewing machine. Carried on the bed 11 is a slide plate 12 and a throat plate 13 formed with a needle aperture 14 and feed dog slots 15 through which a feed dog 16 projects. Also shown in FIG. 1 is a fragment of a sewing machine head 17 in which a needle bar 18 is carried for endwise reciprocation and lateral jogging. A thread carrying needle 19, clamped to the needle bar 18, traverses the needle aperture 14 in the throat plate 13 in the formation of stitches. Also carried in the sewing machine head 17 is a presser bar 20 to the end of which is attached, by any conventional means, the presser device 30 of this invention.

The presser device 30 comprises a presser foot 32 pivotably attached to the presser bar 20. The presser foot 32 has a needle aperture 34 formed therein through which the needle 19 reciprocates in the formation of stitches and indicia 36 extending from the needle aperture 34 to both sides of the presser foot 32. Slidably embracing the presser foot 32 is a work engaging shoe 40 having a flat sole portion 42 which underlies the presser foot 32 and overlies the feed dog 16. Formed in the sole portion 42 is a longitudinal slot 44 for providing clearance for needle reciprocation during buttonhole stitching. Attached to the rearward portion of the work engaging shoe 40 is a button gauging device 50.

The button gauging device 50 comprises a first buttonholder 52 fixably mounted at the end of the work engaging shoe 40 and a second buttonholder 54 slidably disposed on the work engaging shoe 40 opposite the first button holder 52 whereby a button placed therebetween would be grasped by sliding the second buttonholder 54 toward the first buttonholder 52. The first buttonholder 52 is formed with a stop portion 53 for limiting the forward travel of the work engaging shoe 40 by abutting the presser foot 32 at the rearward edge 33 thereof. The second buttonholder 54 is formed with two projecting portions 56 and 58 which extend forwardly on the work engaging shoe 40 on opposite sides of the presser bar 20. Extending upwardly from the projecting portion 56 is a comming tab 60 for engaging a tripping rod lever (not shown) of a buttonholing mechanism as described in U.S. Pat. No. 3,841,246 by Castner et al.

The ends of the projecting portion 56 and 58, which are preferably equidistant and marked by indicia 62, extend to a point in advance of the indicia 36 on the presser foot 32 when the work engaging shoe 40 is in its forwardmost position forming the indicating means of this invention. This point is determined by the size of a button grasped between the two buttonholders, 52 and 54; the distance between the indicia, 36 and 62, being equivalent to the length of a buttonhole required to accommodate the button selected.

In operation, a button is placed between the two buttonholders, 52 and 54, which are then closed upon the button by sliding buttonholder 54 toward the holder 52. The presser device 30 is then lowered on to the material maintaining the work engaging shoe 40 in its forward most position. This position is indicated in FIG. 5A. Zig-zag stitching is then commenced first with the sewing machine controls adjusted to form a bar 80 and then to form side stitches 81 at one side of the buttonhole. Since the work engaging shoe 40 is free to slide with respect to the presser foot 32, it advances rearwardly with the material, which, in turn, brings indicia 62 closer to indicia 36. When the indicia, 62 and 36, are in line, as in FIG. 5B, this serves as a signal to the operator to adjust the sewing machine controls first to form a bar 83 at the end of the buttonhole (FIG. 5C) and then, by reverse stitching, and narrowing the zig-zag controls to form the side stitches 84 along the opposite side of the buttonhole (FIG. 5D).

To insure that the working engaging shoe 40 is always in its forwardmost position when initiating a buttonhole, biasing means in the form of a coiled leaf spring 70 is attached to the rear of the presser foot 32 and occupies a cavity 71 beneath the buttonholder 52 defined by flange 69 depending therefrom.

As disclosed in U.S. Pat. No. 3,877,403 of Ketterer, a thin plate 72 having an upward extending portion 74 may be arranged in conjunction with the work engaging shoe 40 for sandwiching the material being sewn therebetween. A holder 76, mounted to the work engaging shoe 40, is provided for carrying the plate 72 and is formed with a slot 78 therein for slidably receiving the upward extending portion 74 of the plate 72.

Having thus set forth the nature of this invention, what I herein claim is:

1. A buttonhole gauging presser device for a sewing machine having a presser bar, a work feeding mechanism for transporting work fabrics in a transverse direction across said sewing machine, and a needle carried for endwise reciprocatory movement in a path located in front of the presser bar in the direction of work feed, said buttonhole gauging presser device comprising:

a. a presser foot adapted to be secured to the sewing machine presser bar and including work fabric constraining means contiguous to the path of needle reciprocation;

b. a work engaging shoe slidably constrained on said presser foot for movement with said work fabrics in the direction of work feed;

c. stop means on said work engaging shoe for establishing a forwardmost position in front of the presser bar in the direction of work feed; and d. indicating means adjustably positionable on said work engaging shoe at a distance in front of the location of said path of needle reciprocation which, when said work engaging shoe occupies said forwardmost position in front of said presser bar, is equal to the desired length of a buttonhole, whereby during the fabrication of a buttonhole, said indicating means is brought into visual alignment with said path of needle reciprocation thereby indicating the completion of the desired size buttonhole.

2. A buttonhole gauging presser device as set forth in claim 1 which further includes means for biasing said work engaging shoe against said stop means.

3. A buttonhole gauging presser device for a sewing machine having a presser bar, a work feeding mechanism for transporting work fabrics in a transverse direction across said sewing machine, and a needle carried for endwise reciprocatory movement in a path located in front of the presser bar in the direction of work feed, said buttonhole gauging device comprising:

a. a presser foot adapted to be secured to the sewing machine presser bar and including work fabric constraining means contiguous to the path of needle reciprocation;

b. a work engaging shoe slidably constrained on said presser foot for movement with said work fabrics in the direction of work feed;

c. stop means on said work engaging shoe for establishing a forwardmost position in front of the presser bar in the direction of work feed;

d. opposed button engaging elements carried on said work engaging shoe and including a first button engaging element fixed on said work engaging shoe and a second button engaging element slidably supported on said work engaging shoe for movement toward and away from said first button engaging element; and e. indicating means carried by said second button engaging element and extending a distance in front of the location of said path of needle reciprocation which, when said work engaging shoe occupies said forwardmost position in front of the presser bar, is equal to the length of a buttonhole adequate to accommodate a button engaged between said opposed button engaging elements, whereby, during the fabrication of a buttonhole, said indicating means is brought into visual alignment with said path of needle reciprocation thereby indicating the completion of the desired size buttonhole.

4. A buttonhole gauging presser device for use both on plain zig-zag sewing machines and on sewing machines having a buttonhole producing mechanism therein which includes linkage adjacent to said presser device for influencing said buttonhole mechanism to produce an appropriately sized buttonhole, said presser device comprising:

a. a presser foot adapted to be secured to a sewing machine presser bar;

b. a work engaging shoe slidably constrained on said presser foot for movement with work fabrics in the direction of work feed;

c. buttonholders carried on said work engaging shoe including a first buttonholder fixed on said work engaging shoe and a second buttonholder shiftably supported on said work engaging shoe selectively to accommodate any one of a range of different size buttons therebetween;

d. cam means associated and movable with said second buttonholder on said work engaging shoe for engaging said linkage of said buttonhole mechanism indicating the desired size of a buttonhole; and e. separate visual indicating means including a first indicating means associated and movable with said second buttonholder and a second indicating means on said presser foot, said indicating means being progressively brought into visual alignment during the fabrication of a buttonhole, to indicate the desired size buttonhole.

5. A buttonhole gauging presser device as set forth in claim 4 wherein said first indicating means comprises: indicia inscribed on said presser foot and said second indicating means comprises said second buttonholder being formed with at least one forwardly extending projection having indicia inscribed at the end thereof.

6. A buttonhole gauging presser device as set forth in claim 4 which further comprises biasing means for urging said work engaging shoe to its forwardmost position.

* * * * *